United States Patent [19]

Nagashima

[11] Patent Number: 4,641,563

[45] Date of Patent: Feb. 10, 1987

[54] ELECTRONIC MUSICAL INSTRUMENT

[75] Inventor: Yoichi Nagashima, Shizuoka, Japan

[73] Assignee: Kabushiki Kaisha Kawai Gakki Seisakusho, Japan

[21] Appl. No.: 760,315

[22] Filed: Jul. 29, 1985

[30] Foreign Application Priority Data

Jul. 31, 1984 [JP] Japan ..... 59-162049

[51] Int. Cl.[4] ..... G10H 1/02; G10H 1/057; G10H 5/04

[52] U.S. Cl. ..... 84/1.01; 84/DIG. 11; 84/1.19; 84/1.26

[58] Field of Search ..... 84/1.1, DIG. 11, 1.13, 84/1.26, 1.19, 1.01

[56] References Cited

U.S. PATENT DOCUMENTS 4,273,019 6/1981 Goto ..... 84/DIG. 4

4,528,885 7/1985 Chihana ..... 84/1.1

4,537,108 8/1985 Shiramizu ..... 84/DIG. 11

*Primary Examiner*—Arthur T. Grimley

*Assistant Examiner*—David Warren

*Attorney, Agent, or Firm*—McGlew and Tuttle

[57] ABSTRACT

An electronic musical instrument is provided with a first programmable counter for generating a reference clock signal corresponding to a musical frequency and a plurality of cascade-connected programmable counters which are each triggered by the preceding programmable counter. A multi-level signal which assumes one of a plurality of levels for each period specified by one of the cascade-connected programmable counters is output as a primary waveform. The electronic musical instrument is capable of setting various variations of the primary waveform abundantly containing harmonics and is satisfactory in the tone quality and in the degree of freedom in setting tones, and hence is of high musicality.

3 Claims, 8 Drawing Figures

ELECTRONIC MUSICAL INSTRUMENT

BACKGROUND OF THE INVENTION

1. Field of the Invention

The present invention relates to an electronic musical instrument which creates a musical tone through use of a tone filter for a primary waveform signal abundantly containing harmonics.

2. Description of the Prior Art

Conventionally, a musical tone generating system for electronic musical instrument, represented by an electronic organ, a synthesizer and so forth, is roughly divided into an analog and a digital tone generating system. The digital tone generating system permits the synthesization of musical waveform elements by digital operations and has possibilities of creating timbre over a wide range. But the digital tone generating system has the defects of an enormous circuit arrangement and limitations on the sound synthesis owing to restrictions on the amount of operation and the operation time, and have been employed only in some high grade models. The analog tone generating system is comprised of a primary waveform generator which generates a primary waveform signal corresponding to a musical frequency and abundantly containing harmonic components, a filter circuit for controlling the harmonic components of the primary waveform signal in accordance with timbre desired to create and an envelope circuit for providing a desired envelope. These circuit elements are well-known VCO (Voltage-Controlled Oscillator), VCF (Voltage-Controlled Filter) and VCA (Voltage-Controlled Amplifier) which use voltage as a common control parameter, and have undergone various improvements. Also in connection with the analog tone generating system, many problems have been pointed out. For instance, the tone generating circuit has not markedly been improved as compared with other circuit elements of the musical instruments. Conventional tone generating circuits are mostly liable to produce what is called a "characteristic tone" which has a specific harmonic structure, and the "character" cannot be removed however intensively the tone is subjected to filtering by a tone filter. The reason for this is that since frequencies handled by the tone generating circuit are note frequencies which vary with the playing status, is is very difficult to form a predetermined primary waveform signal at any of the frequencies, which has been effected mostly by a duty ratio changing method through use of an even-order frequency divider. It has also been proposed to set the duty ratio or generate a pulse train by the employment of a shift register, ring counter, Johnson counter or the like. But these prior art methods are within the scope of an integral multiple of a basic clock signal, and are unable to completely eliminate the "character". Even if a circuit for producing a certain primary waveform signal should be implemented through utilization of complex and elaborate techniques, it would encounter the problems that in the case of creating a plurality of tones, no variations cannot be produced and that if many tones are produced, their tonal quality will be degraded.

SUMMARY OF THE INVENTION

It is therefore a primary object of the present invention to provide an electronic musical instrument which is free from the above said defects of the prior art.

Briefly, stated, the electronic musical instrument of the present invention is provided with a first programmable counter which produces a reference clock signal corresponding to a musical frequency and a plurality of cascade-connected programmable counters which are respectively triggered by the preceding-stage programmable counter one after another. A multilevel signal is created as a primary waveform which assumes one of plural kinds of levels for each period specified by one of the cascade-connected programmable counters. The electronic musical instrument of the present invention permits setting of many variations of the primary waveform which abundantly contains complex harmonics, and hence satisfies the requirements of tonal quality and the freedom in setting tones and is rich in musicality.

Other objects, features and advantages of the present invention will become more fully apparent from the following detailed description taken in conjunction with the accompanying drawings.

DESCRIPTION OF THE PREFERRED EMBODIMENTS

Figure 1:
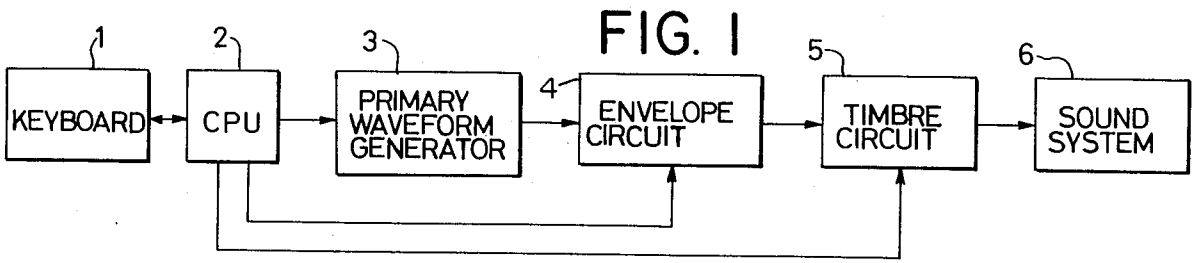
FIG. 1 is a conceptual diagram explanatory of the arrangement of the electronic musical instrument of the present invention.

In FIG. 1 reference numeral 1 indicates a keyboard, 2 a CPU for controlling the entire system, 3 a primary waveform generator according to the present invention, 4 an envelope circuit, 5 a timbre circuit and 6 a sound system.

The CPU 2 detects play or performance information of the keyboard 1 and performs required processing, for instance, for generator assignment, setting of timbre, setting of a musical frequency, setting of various parameters and so forth. The primary waveform generator 3 generates a desired primary waveform signal in accordance with various parameters from the CPU 2. The primary waveform signal is converted by the envelope circuit 4 and the timbre circuit 5 to a musical signal, which is further converted by the sound system 6 including an effect circuit, an amplifier and a speaker to an acoustic signal.

Figure 2:
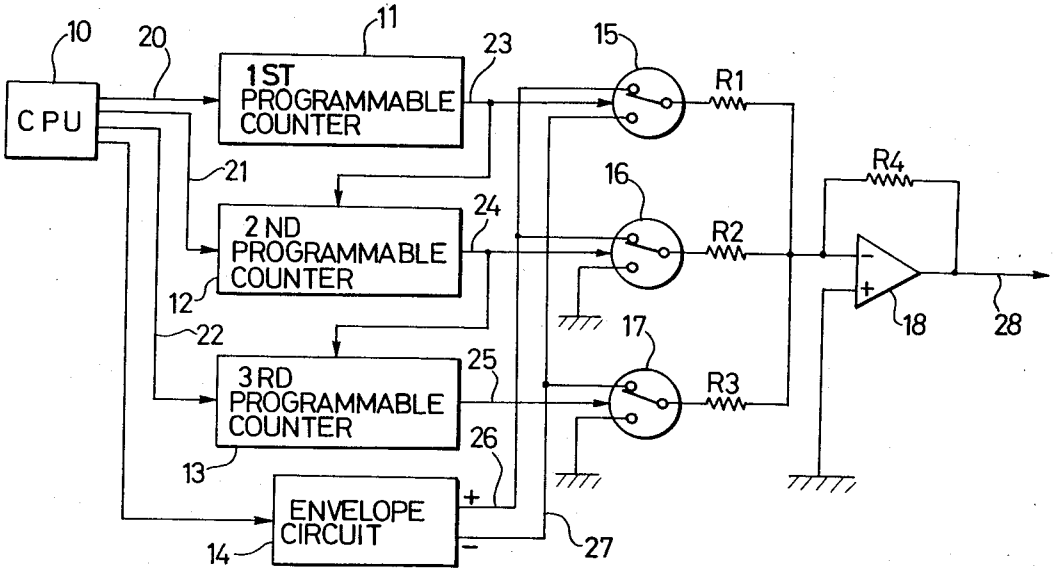
FIG. 2 is a block diagram illustrating a specific arrangement of the principal part of the present invention including a primary waveform generator 3 and an envelope circuit 4 in FIG. 1.

FIG. 2 illustrates in block form a specific circuit arrangement of a primary waveform generating and envelope producing part according to the present invention which is implemented by the primary waveform generator 3 and the envelope circuit 4 in FIG. 1.

Reference numeral 10 indicates a CPU, 11 a first programmable counter, 12 a second programmable counter, 13 a third programmable counter, 14 an envelope generator, 15 a first analog switch, 16 a second analog switch, 17 a third analog switch and 18 a mixing amplifier. Now a description will be given of the first, second and third programmable counters 11, 12 and 13 which are individually controlled by the CPU 10. The programmable counters 11 to 13 are each capable of frequency dividing an input clock signal at a desired rate in accordance with programmable frequency dividing data which is supplied from the CPU 10, and they can easily be implemented using, for example, Intel's "8253" type CPU peripheral LSI. In many cases programmable counters of such CPU peripheral LSIs have, in addition to an ordinary frequency dividing mode, variations of operation modes such as, for example, a one-shot operation mode, a control trigger signal input mode and so forth. The example in FIG. 2 also selectively utilizes such operation modes. The first programmable counter 11 is activated in a mode in which it normally performs a programmable frequency division to produce an output signal of a 50% duty ratio. The second programmable counter 12 is activated in a "programmable one-shot operation" mode in which it is triggered ON by the positive-going edge of the output signal of the first programmable counter 11 and enters and remains in its OFF state after counting a preset length of time. The third programmable counter 13 is also activated in a "programmable one-shot operation" mode in which it is triggered ON by the negative-going edge of the output signal of the second programmable counter 12 and enters and remains in its OFF state after counting a preset length of time. Such operations of the programmable counters can be set simply by applying an output signal 23 of the first programmable counter 11 to a gate signal input of the second programmable counter 12 and by applying an output signal 24 of the second programmable counter 12 to a gate signal input of the third programmable counter 13 after inverting the signal 24, as required. Further, it is necessary only that commands for setting the operation modes of the respective programmable counters be provided thereto by control signals 20, 21 and 22.

Figure 3:
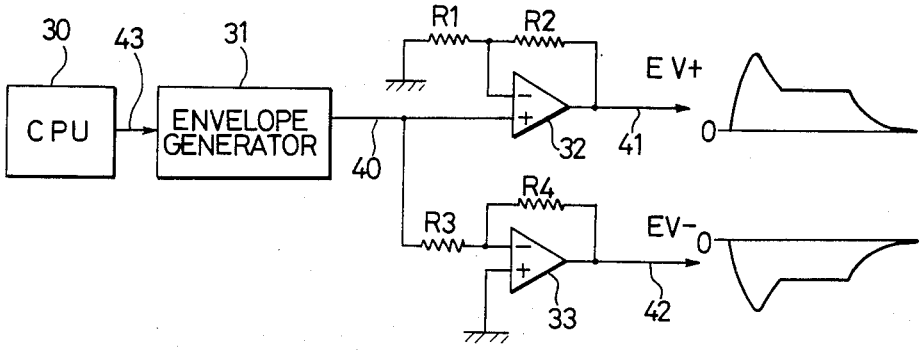
FIG. 3 is a circuit diagram illustrating a specific arrangement of an envelope circuit 12 in FIG. 2.

FIG. 3 illustrates in detail an example of the arrangement, of the envelope circuit 14 used in the example depicted in FIG. 2. The envelope circuit 14 does not use an ordinary single envelope signal but handles two kinds of envelope signals, i.e. a positive envelope signal 26 and a negative envelope signal 27. On account of this, the envelope circuit 14 comprises an inverting amplifier 33 and a non-inverting amplifier 32 other than an envelope generator 31 which is controlled by the CPU 30, as shown in FIG. 3. In the above arrangement, since the envelope generator 31 needs only to create an ordinary single envelope signal, a conventional envelope generating system is employed therefor. It is, for example, as an analog system, a system which effects charging and discharging through use of a time constant circuit, as in a music synthesizer, and, as a digital system, a system which reads out an envelope memory and D-A converts the output signal and, as a combination of the analog and digital systems, a system in which charging and discharging by pulses of a fixed current are controlled in terms of the number of pulses. An output signal 40 of the envelope generator 31 is provided to the inverting and non-inverting amplifiers 33 and 32 which are both formed by operational amplifiers or the like, and by which are produced positive and negative envelope signals 41 and 42. The magnitudes of the absolute values of the two envelope signals 41 and 42 can be freely set by suitably selecting the resistance values of resistors R1, R2, R3 and R4 which are connected to the operational amplifiers, respectively.

Figure 4:
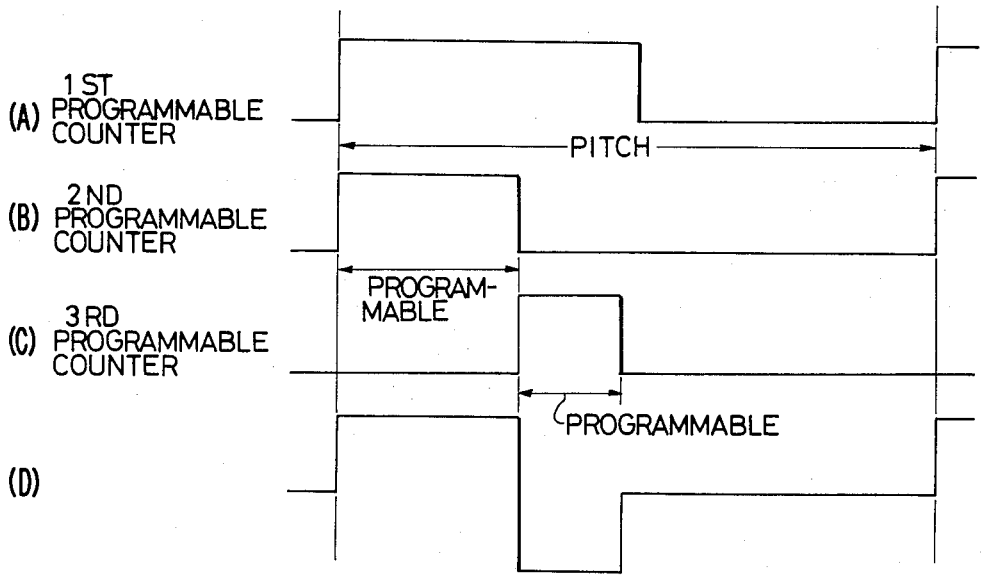
FIGS. 4A to 4D, 5A and 5B are waveform diagrams for explaining the operation of the circuit shown in FIG. 2.

The positive and negative envelope signals 26 and 27, obtained by such circuit arrangement as shown in FIG. 3, are provided as switch input signals to the first, second and third analog switches 15, 16 and 17. Supplied as control signals to the first to third analog switches 15 to 17 are the output signals of the first to third programmable counters 11 to 12, respectively. These input control signals are shown in FIG. 4. The first programmable counter 11 operates in the mode in which it performs, in its steady state, the programmable frequency division to yield an output signal of a 50% duty ratio, as mentioned previously, and it responds to the control signal 20 from the CPU 10 to produce such an output signal as shown in FIG. 4A which has a period corresponding to the musical frequency to be generated. This output signal is applied as the input control signal 23 to the first analog switch 15. The second programmable counter 12 performs such a "programmable one-shot operation" that it is triggered ON by the positive-going edge of the output signal 23 of the first programmable counter 11 and enters and remains in the OFF state after counting a length of time set by the control signal 21 from the CPU 10, thereby producing such an output signal as depicted in FIG. 4B, which is provided as the input control signal 24 to the second analog switch 16. The third programmable counter 13 performs such a "programmable one-shot operation" that it is triggered ON by the negative-going edge of the output signal 24 of the second programmable counter 12 and enters and remains in the OFF state after counting a length of time set by the control signal 22 from the CPU 10, thereby yielding such an output signal as shown in FIG. 4C, which is provided as the input control signal 25 to the third analog switch 17. FIG. 4D shows a signal which takes a fixed positive level during the ON state of the output signal 24 of the second programmable counter 12 and assumes a fixed negative level during the ON state of the output signal 25 of the third programmable counter 13. This is the basic idea of the primary waveform generating system according to the present invention. Since the output signal 23 of the first programmable counter 11 is a mere reference signal for the second and third programmable counters 12 and 13 to conduct the "programmable one-shot operation" with a period corresponding to the musical frequency, the first analog 15 can be dispensed with basically.

Figure 5:
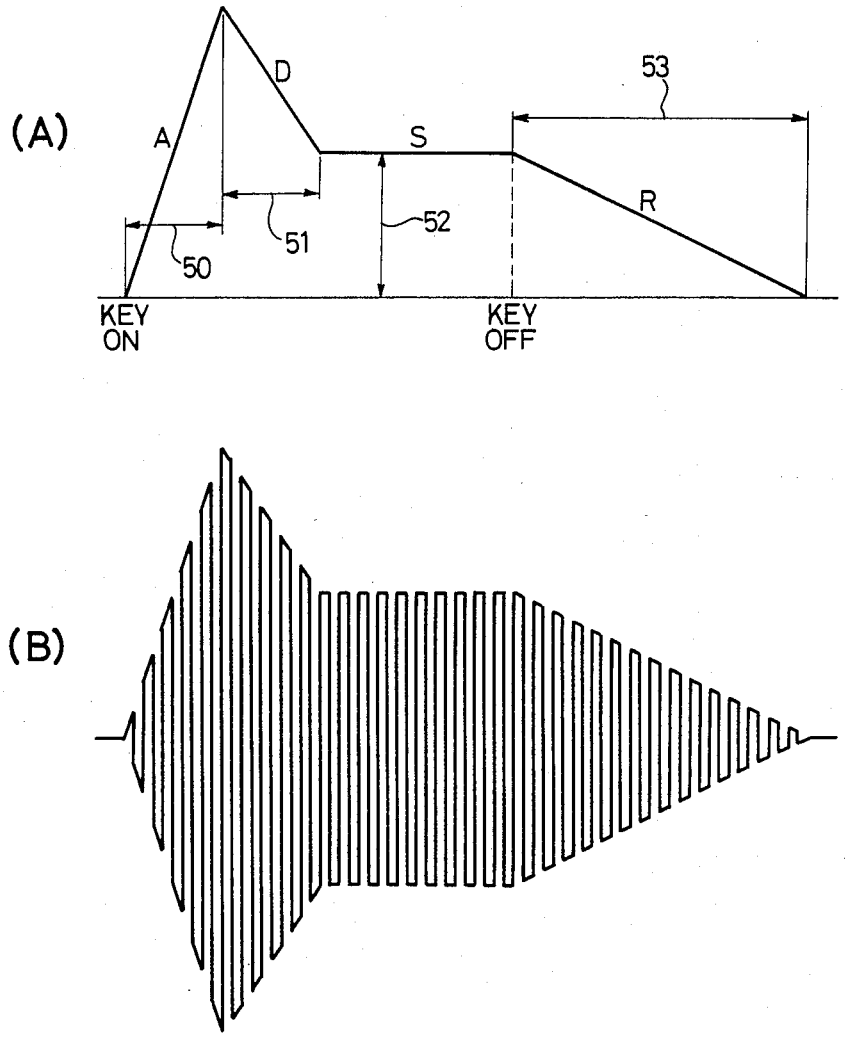

FIG. 5 is a signal diagram for explaining the operation of the circuit arrangement shown in FIG. 2. The circuit arrangement of FIG. 2 carries out, by itself, not only the generation of a primary waveform but also an envelope modulation, and hence offers a low cost electronic musical instrument with a very simple structure. Since its principles of operation are difficult to understand as compared with the envelope modulation by an ordinary VCA (Voltage-Controlled Amplifier), however, the first analog switch 15 which is controlled by the output signal 23 of the first programmable counter 11 will be described in detail, by way of example. As the positive output signal 26 of the envelope generator 14 in FIG. 2, an envelope signal such, for example, as shown in FIG. 5A, is provided. This envelope signal is formed using, as parameters, such four states as indicated by A (Attack), D (Decay), S (Sustain) and R (Release) in FIG. 5A. These parameters are set, by the CPU 10, as an attack time 50, a decay time 51, a sustain level 52 and a release time 53. Let is be assumed here that the negative output signal 27 of the envelope generator 14 is provided as a signal which is equal in absolute value to but opposite in polarity from the positive output signal 26. These positive and negative envelope signals 26 and 27 are applied as switch input signals corresponding to make and break terminals of the first analog switch 15, and either one of them is selected under control of the output signal 23 of the first programmable counter 11. In consequence, the positive and negative envelope signals are alternately output from the first analog switch 15 with a period corresponding to the musical frequency, and are supplied to the mixing amplifier 18. This is shown in FIG. 5B, from which it will be seen that the positive, and negative signals are switched by a pitch signal.

Figure 6:
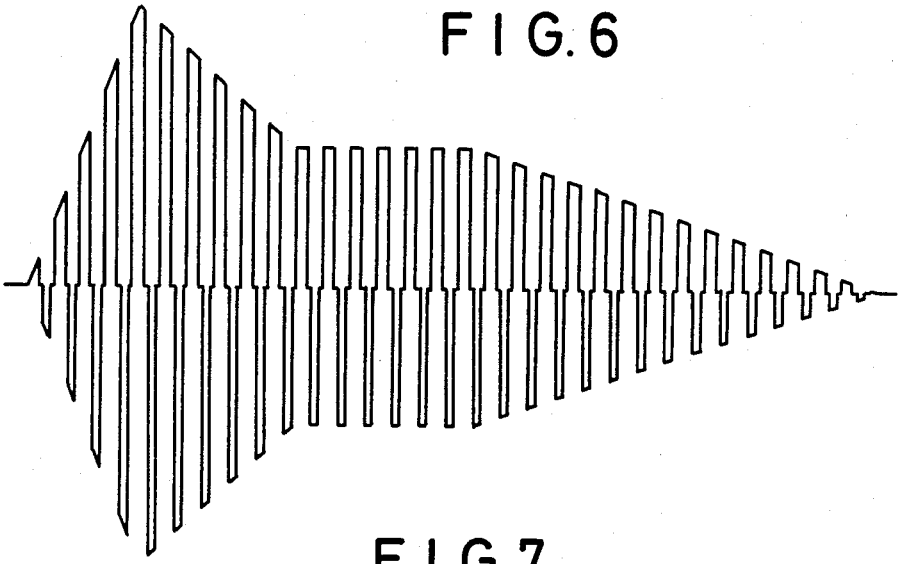
FIG. 6 is a signal diagram showing another example of operation for explaining the operation of the circuit depicted in FIG. 2.

FIG. 6 is a signal diagram for explaining another example of operation of the circuit arrangement shown in FIG. 2. This is an example of operation by the second and third programmable counters 12 and 13, this is the most practical embodiment of the primary waveform generating system according to the present invention. In FIG. 6 the signal assumes three kinds of values. A first one of them is a signal level in the state in which the positive envelope signal 26 is selected by the second analog switch 16 under control of such an output signal 24 from the second programmable counter 12 as shown in FIG. 4B. This corresponds to a portion above the zero level in FIG. 6. The second value is a signal level in the state in which the negative envelope signal 27 is selected by the third analog switch 17 under control of such an output signal 25 from the third programmable counter 13 as shown in FIG. 4C. This corresponds to the portion below the zero level in FIG. 6. The third value is a signal lever in the state in which the output signals of the second and third programmable counters 12 and 13 are both inactive and the second and third analog switches 16 and 17 both select the zero level. This corresponds to the portion at the zero level in FIG. 6. In FIG. 6 the time from the instant when the second programmable counter 12 becomes inactive to the instant when the third programmable counter 13 becomes active is shown in exaggeration in the interests of clarity. Conversely, in the case of requiring such a signal waveform as shown in FIG. 6, it is necessary only to provide a fourth programmable counter which is triggered at the instant when the second programmable counter becomes inactive, stays in its ON state for a required period of time set by the programmable one-shot operation and supplies its end signal, as a trigger signal, to the third programmable counter 13.

Figure 7:
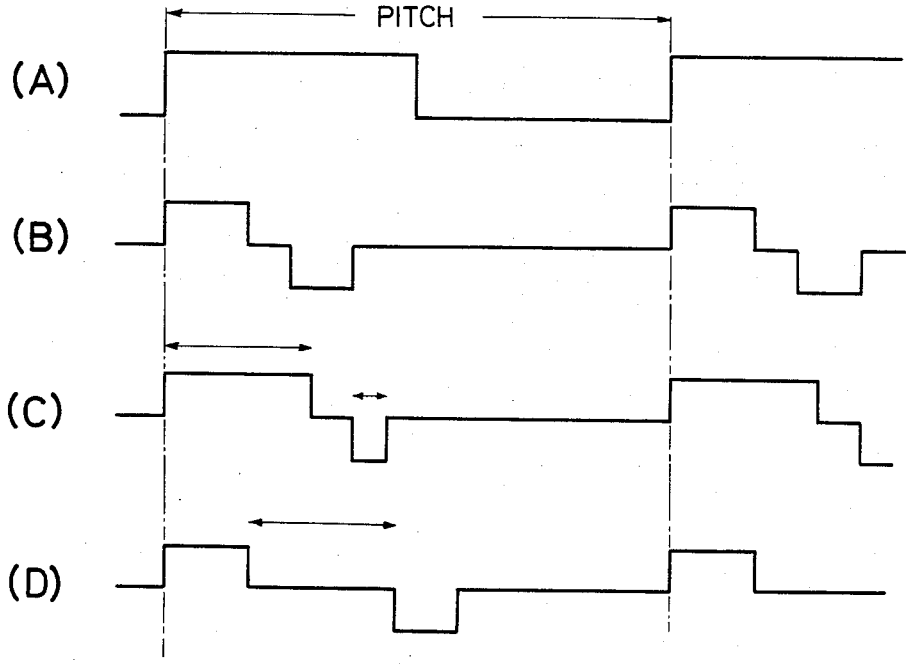
FIG. 7A to 7D are waveform diagrams for explaining another example of operation of a primary waveform generating system according to the present invention.

FIG. 7 is a signal diagram for explaining another operation of the primary waveform generating system according to the present invention. In the above a certain primary waveform is set by an arrangement composed of a first programmable counter which generates a reference clock signal corresponding to the musical frequency and a plurality of cascade-connected programmable counters which are each triggered by the preceding stage programmable counter. The primary waveform need not be constant in the steady state once it is set, but is controllable by a control signal from the CPU in real time. This is also an important feature of the primary waveform generating system according to the present invention. FIG. 7A shows the output signal of the first programmable counter. The first programmable counter is set by the control signal from the CPU to operate in such a mode that it performs a programmable frequency division in its steady state to create an output signal of a 50% duty ratio and a period corresponding to the musical frequency to be generated. FIG. 7B shows an example of the output signal in the case where a certain primary waveform is set by the arrangement composed of the plurality of programmable counters each of which is triggered by the preceding programmable counter. This can easily be implemented through use of a second programmable counter which determines a period of time for which the primary waveform takes a fixed positive level, a third programmable counter which determines a period of time for which it takes the zero level, and a fourth programmable counter which determines a period of time for which it takes a fixed negative level. Now consider the state in which these programmable counters are controlled by the CPU in an actual electronic musical instrument. Since the musical frequency of a musical tone to be created varies with the playing status, the period of the output signal of the first programmable counter, shown in FIG. 7A, is set first in accordance with the musical frequency. Then programmable frequency division data for the second, third and fourth programmable counters are individually set as data corresponding to the musical frequency of the musical tone to be created. The programmable frequency division data needs only to be prepared as data in a ROM provided in the CPU system, or as data which is stored in a RAM in the CPU system when the power supply is connected to the system. In the latter case, it is possible to employ, for example, a method in which only base data is stored in a ROM and the other data is individually set in a RAM by an operation in terms of software, or a method which transfers data from an external auxiliary storage means such as a ROM pack, bubble cassette, floppy disc or the like to a RAM. Even if such a primary waveform signal as shown in FIG. 7B is thus obtained, the primary waveform generating system is insufficient for generating a primary waveform in the electronic musical instrument if it merely continues to produce such a primary waveform in the steady state. Now consider musical waveforms of natural musical instruments. As is marked in musical instruments such as a piano, a trumpet, etc., tone usually undergoes changes with time, and tone seldom remains unchanged as in a pipe organ. Two methods can be utilized for implementing such temporal variations of tone in an electronic musical instrument. One is to have temporal variations in the characteristic of the tone filter circuit, and the other is to directly change the parameters with time in the primary waveform generating portion. Since conventional primary waveform generating systems are not only low in the degree of freedom in selecting the shape of the primary waveform that can be generated, but also encounter difficulty in changing the parameters of the primary waveform, there has been employed exclusively the system which provides temporal characteristic variations in the tone filter circuit portion. However, the temporal variations operable by the tone filter circuit are also limited, and hence are not satisfactory. According to the primary waveform generating system of the present invention, the parameters of the primary waveform to be created can arbitrarily be set by data signals which are supplied as programmable frequency division data of the second, third and fourth programmable counters from the CPU, and the parameters can easily be changed in real time by means of hardware provided in the CPU system or software of the CPU itself. This is nothing but the temporal variation of the primary waveform, i.e. temporal variation of tone to be created. Accordingly, the present invention offers a tone generating system which allows ease in causing temporal variation in tone which has been difficult with the conventional analog type electronic musical instruments. Even if such a temporal variation in tone for the primary waveform signal shown in FIG. 7B, the abovesaid primary waveform generating portion is not satisfactory if it merely continues to generate the waveform with such parameter changes alone. Now consider musical waveforms of natural musical instruments. As is remarkable in a saxophone, a guitar and other similar instruments, tone usually varies with the strength of playing operation, that is, touch response in a keyboard instrument, and tone seldom remains unchanged regardless of touch as in a pipe organ. Such tonal variations with touch response can be implemented in electronic musical instruments by two methods, that is, one is to have a touch response characteristic in the tone filter circuit portion and the other is to directly change the parameters in the primary waveform generating portion according to touch response information. Since the prior art primary waveform generating system is not only low in the degree of freedom in selecting the shape of the primary waveform that can be created, but also encounter difficulty in causing changes in the parameters of the primary waveform, there has been employed exclusively the system in which the tone filter circuit portion is give a touch response characteristic. But the touch response that can be obtained with the tone filter circuit is also limited, and hence is not always satisfactory. According to the primary waveform generating system of the present invention, the parameters of the primary waveform that is to be produced can freely be set by data signals which are supplied as programmable frequency division data of the second, third and fourth programmable counters, and these parameters can easily be varied instantly by means of hardware in the CPU system or software of the CPU in accordance with touch response information. This is no other than a touch response change in the shape of the primary waveform, i.e. a tonal variation for touch response. Accordingly, the present invention offers a tone generating system which permits the touch response variation in the tone which has been difficult with the conventional analog type electronic musical instruments. As described above, the primary waveform generating system of the present invention easily implements the temporal variation of the primary waveform corresponding to the temporal variation of tone and the touch response variation of the primary waveform corresponding to the touch response variation of tone. FIG. 7C shows how this is achieved. Since the length of each arrow can freely be controlled, it is possible to arbitrarily set a primary waveform abundantly containing harmonics. By selecting an integral multiple of the length of this pulse to agree with the musical frequency in FIG. 7A, the so-called "characteristic tone" having a specific harmonic suppressed, peculiar to wind instruments, is produced. Conversely, by slightly deviating the pulse length, it is possible to obtain a tone which contains many harmonics as in the case of a piano or the like. FIG. 7D shows how the interval between two positive and negative pulses is controlled. The length of the arrow can freely be controlled. This is a control parameter which is of particular utility when employed in creating a piano sound. In the sound producing mechanism of a piano, a part of a music wire with high tension is instantaneously struck by a hammer, and impulses are reflected at opposite fixed ends of the music wire. The music wire can be regarded as vibrating in its steady state in such a waveform as shown in FIG. 7D. The control of the interval between the two pulses can be used as a relative change in position of the striking point of the hammer, i.e. as a variation in the primary waveform corresponding to the note range, and it can also be utilized in the tonal variations with time.

Figure 8:
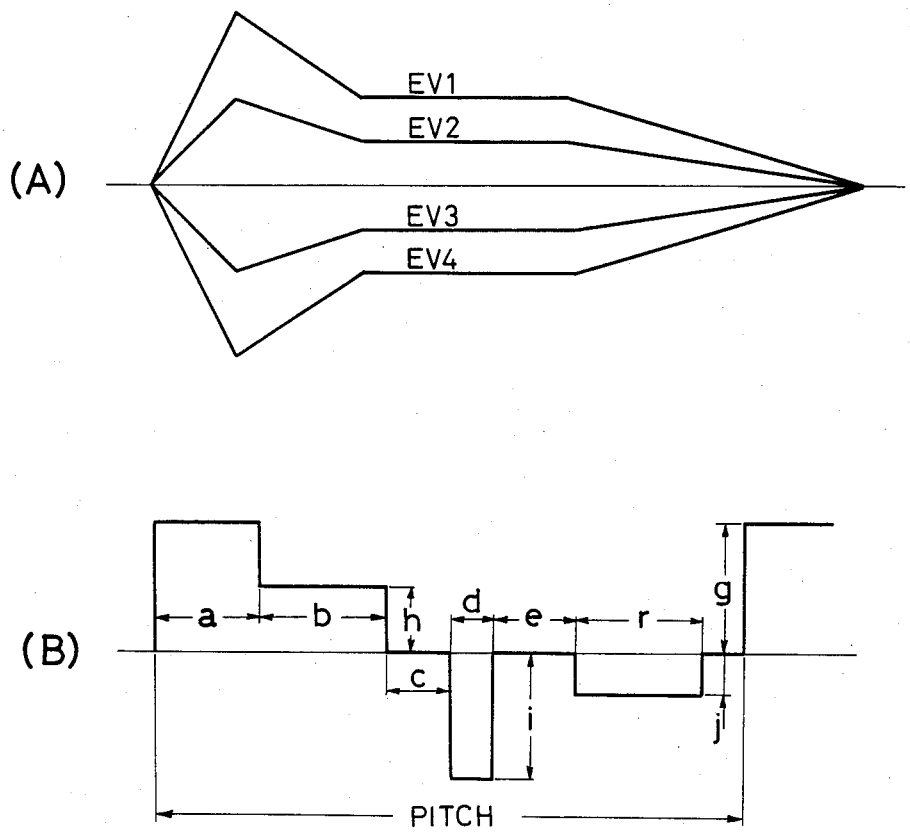
FIGS. 8A and 8B are signal diagrams for explaining another operation of the primary waveform generating system according to the present invention.

FIGS. 8A and 8B are signal diagrams for explaining another operation of the primary waveform generating system of the present invention. In this case, the primary waveform generating section is comprised of a first programmable counter which produces a reference clock signal corresponding to the musical frequency, and seven cascade-connected programmable counters each of which is triggered by the preceding programmable counter, and a multilevel signal is created which takes one of five kinds of levels for each period specified by one of the cascade-connected programmable counters. The five kinds of levels herein mentioned are a preset positive first envelope signal EV1, a positive second envelope signal EV2 the level of which is one-half that of the first envelope signal EV1, a negative third envelope signal EV3 is obtained by inverting the second envelope signal EV2, a negative fourth envelope signal EV4 obtained by inverting the first envelope signal EV1 and the zero level. FIG. 8B shows how the multilevel signal which assumes one of the five levels for each specified period is generated by the seven cascade-connected programmable counters. As parameters representing the abovesaid five levels are shown a level parameter g representing the preset positive first envelope signal EV1, a level parameter h representing the positive second envelope signal EV2, a level parameter j representing the negative third envelope signal EV3 and a level parameter i representing the negative fourth envelope signal EV4. As the time for which these levels are selected are shown a time parameter a representing the period which is specified by the second programmable counter, a time parameter b representing the period which is specified by the third programmable counter, a time parameter c representing the period which is specified by the fourth programmable counter, a time parameter d representing the period which is specified by the fifth programmable counter, a time parameter e representing the period which is specified by the sixth programmable counter and a time parameter f representing the period which is specified by the seventh programmable counter. With such an arrangement, the primary waveform obtainable with combinations of these parameters undergoes substantial variations, and it is also possible to create the primary waveform by, for instance, giving a specific meaning to each of the parameters. That is, a character corresponding to so-called "formant" is set first as the basic harmonic structure of the musical tone by substantially fixing the periods of the parameters a, b and f. Then the period of the parameter d is set very short just like an impulse signal. In such a case, the portion corresponding to the period of the parameter d forms a so-called "noisy" musical tone element which does not substantially affect the basic harmonic structure of the musical tone but rather contains a lot of very higher harmonics, and effectively functions to create a tone of, for instance, a harpsicord, sitar or similar instrument. Furthermore, variations of the periods of the parameters c and e in real time are effective for producing a tone of temporal variations, such as a piano sound, as compared with variations of the periods of the parameters a, b and f. Thus the primary waveform can effectively controlled without the necessity of controlling all the parameters at all time.

As described above, the present invention offers a primary waveform generating system which creates a primary waveform signal of many variations with a simple arrangement and performs an envelope modulating operation as well and, further, easily implements temporal variations of the primary waveform corresponding to temporal variations of a tone and touch response variations of the primary waveform corresponding to touch response variations of the tone which are difficult to implement by the conventional electronic musical instruments of the analog system. Accordingly, the present invention provides, at a relatively low cost, an electronic musical instrument of high musicality which satisfactory in the tone quality and the degree of freedom of setting the tone, and hence greatly contributes to the production of good music.

It will be apparent that many modifications and variations may be effected without departing from the scope of the novel concepts of the present invention.

What is claimed is:

1. An electronic musical instrument which is provided with a first programmable counter for generating a reference clock signal corresponding to a musical frequency, and a plurality of cascade-connected programmable counters which are each triggered by the preceding programmable counter, whereby a primary waveform is generated as a multilevel signal which takes one of a plurality of levels for each period specified by one of the cascade-connected programmable counters, a first programmable counter for generating a reference clock signal corresponding to the musical frequency, a second programmable counter which is triggered by the first programmable counter, a third programmable counter which is triggered by the second programmable counter and a fourth programmable counter which is triggered by the third programmable counter, whereby the primary waveform is generated as a ternary signal which takes a first level for a period specified by the second programmable counter, a second level for a period specified by the fourth programmable counter and a third level for a period specified by the third programmable counter and for the remaining period.

2. An electronic musical instrument according to claim 1 which includes a first analog switch which is turned ON for one of the periods specified by the programmable counters, a second analog switch which is turned ON for the other period and an envelope generator for generating positive and negative envelope signals, and in which two of the levels of the ternary signal are the levels of the positive and negative envelope signals.

3. An electronic musical instrument which is provided with a first programmable counter for generating a reference clock signal corresponding to a musical frequency, and a plurality of cascade-connected programmable counters which are each triggered by the preceding programmable counter, whereby a primary waveform is generated as a multilevel signal which takes one of a plurality of levels for each period specified by one of the cascadeconnected programmable counters, a first programmable counter for musical frequency, a second programmable counter which is triggered by the first programmable counter and a third progammable counter which is triggered by the second programmable counter, whereby the primary waveform is generated as a ternary signal which takes a first level for a period specified by the second programmable counter, a second level for a period specified by the third programmable counter and a third level for the remaining period, a first analog switch which is tuned ON for one of the periods specified by the programmable counters, a second analog switch which is turned ON for the other period and an envelope generator for generating positive and negative envelope signals, and in which two of the levels of the ternary signal are the levels of the positive and negative envelope signals.

* * * * *